US009319802B2

(12) United States Patent
Norris

(10) Patent No.: US 9,319,802 B2
(45) Date of Patent: Apr. 19, 2016

(54) PERSONAL AUDIO SYSTEM AND METHOD

(71) Applicant: Parametric Sound Corporation

(72) Inventor: Elwood Grant Norris, Poway, CA (US)

(73) Assignee: Turtle Beach Corporation, San Diego, CA (US)

( * ) Notice: Subject to any disclaimer, the term of this patent is extended or adjusted under 35 U.S.C. 154(b) by 194 days.

(21) Appl. No.: 14/026,286

(22) Filed: Sep. 13, 2013

(65) Prior Publication Data

US 2014/0072155 A1 Mar. 13, 2014

Related U.S. Application Data

(60) Provisional application No. 61/700,787, filed on Sep. 13, 2012.

(51) Int. Cl.

*H04R 25/00* (2006.01)
*H04R 3/00* (2006.01)
*H04S 7/00* (2006.01)

(52) U.S. Cl.

CPC ..... *H04R 25/353* (2013.01); *H04R 3/00* (2013.01); *H04R 25/00* (2013.01); *H04S 7/302* (2013.01); *H04R 2217/03* (2013.01); *H04R 2460/03* (2013.01); *H04S 2400/11* (2013.01)

(58) Field of Classification Search

CPC ..... H04R 2217/03; H04R 3/00; H04R 17/10; H04R 19/02; H04R 1/32; H04R 1/323; H04R 1/403; H04R 2201/401; H04R 2203/12; H04R 2420/07; H04R 2460/03; H04R 25/00; H04R 25/353; H04R 25/606; H04R 27/00; H04R 3/04; H04R 3/12

USPC ..... 381/77, 79, 111, 116, 117, 310, 316, 381/191, 312; 361/137, 138; 455/43, 455/46–48, 104, 108–109; 329/349

See application file for complete search history.

(56) References Cited

U.S. PATENT DOCUMENTS 4,541,118 A * 9/1985 Eastmond ..... H04B 1/68 455/102
6,631,196 B1 10/2003 Taenzer et al.

(Continued)

FOREIGN PATENT DOCUMENTS

JP S63236500 10/1988
WO 03/019846 3/2003

OTHER PUBLICATIONS

International search Report and the Written Opinion for International App No. PCT/US2013/059771, mailed Nov. 14, 2013.

*Primary Examiner* — Davetta W Goins
*Assistant Examiner* — Phylesha Dabney
(74) *Attorney, Agent, or Firm* — Sheppard Mullin Richter & Hampton LLP

(57) ABSTRACT

A suppressed carrier audio system can include a modulator having an input configured to receive an audio signal having audio content and configured to modulate the received audio signal onto an ultrasonic carrier to produce a modulated signal; a bandpass filter to receive the modulated signal and suppress or remove the carrier from the modulated signal, and further configured to pass a sideband of the modulated signal thereby creating a suppressed carrier signal; and a first ultrasonic transducer having an input coupled to receive the suppressed carrier signal, the ultrasonic transducer configured to emit the suppressed carrier signal in a direction toward an intended listener. The system can also include a demodulator having a signal generator configured to generate a carrier signal and a second ultrasonic transducer having an input coupled to receive the carrier signal and to emit the carrier signal in a direction toward the intended listener.

20 Claims, 5 Drawing Sheets

(56) References Cited

U.S. PATENT DOCUMENTS

2005/0195985 A1 9/2005 Croft, III et al.
2006/0188115 A1* 8/2006 Lenhardt ..... H04R 25/353 381/312
2011/0033068 A1 2/2011 Hwang et al.
2015/0104026 A1* 4/2015 Kappus ..... G10K 11/178 381/63
2015/0104046 A1* 4/2015 Norris ..... H04R 19/005 381/150
2015/0139439 A1* 5/2015 Norris ..... H04R 1/323 381/77

* cited by examiner

PERSONAL AUDIO SYSTEM AND METHOD

CROSS-REFERENCE TO RELATED APPLICATIONS

This application claims the benefit of U.S. Provisional Patent Application Ser. No. 61/700,767, filed Sep. 13, 2012, entitled "Personal Audio System and Method," which is hereby incorporated herein by reference.

TECHNICAL FIELD

The present invention relates generally to audio systems, and some embodiments relate to suppressed-carrier audio transmission and reception for ultrasonic audio systems. More particularly, some embodiments relate to suppressed-carrier audio systems and methods for hearing aids, assisted listening devices and other audio applications.

BACKGROUND OF THE INVENTION

Hearing aid technology enjoys a long and colorful history. Early hearing aids used in the $18^{th}$ and $19^{th}$ centuries were often referred to as ear trumpets. They essentially consisted of a large horn, or bell, that tapered into a thinner tube for placement in or near the ear. They were large, bulky passive devices that simply increased the volume of sound and provided some noise filtering by directing the desired sound directly into the ear.

Around the turn of the $20^{th}$ century, electronic hearing aids began to enter the market. These were tabletop or desktop items that were cumbersome and impractical, but they provided electronic amplification of the desired sound. While desktop devices were reduced in size over the next few decades, they were still cumbersome units and their battery life was typically only a few hours. With reduction in the size of vacuum tubes, hearing aids shrunk to the point that they were considered "pocket-sized" or "wearable," but were still bulky and required large batteries.

With the advent of the transistor, the hearing aid shrunk dramatically. Indeed, the development of transistors in 1948 by Bell Laboratories allowed numerous improvements to be made to the hearing aid, including a dramatic reduction in size. Making use of the transistor and its decreasing dimensions, companies were able to introduce concealable hearing aids. These devices, sometimes referred to as behind-the-ear devices (BTEs), are still available today. Early examples of BTE devices introduced in the 1950's included the Beltone Slimette, the Zenith Diplomat and the Electone 600.

With continued advancements in technology, the hearing aid continued to shrink in size to become in-the-ear and in-the-ear-canal devices. Today, some hearing aids are so small that they are implantable. However, most conventional hearing aids still require a detector, such as a microphone, to detect the desired audio, an amplifier to amplify the detected audio, and a form of a speaker to produce the desired audio information in amplified form.

BRIEF DESCRIPTION OF THE DRAWINGS

The present invention, in accordance with one or more various embodiments, is described in detail with reference to the accompanying figures. The drawings are provided for purposes of illustration only and merely depict typical or example embodiments of the invention. These drawings are provided to facilitate the reader's understanding of the systems and methods described herein, and shall not be considered limiting of the breadth, scope, or applicability of the claimed invention.

FIG. 5, which comprises

Figure 1:
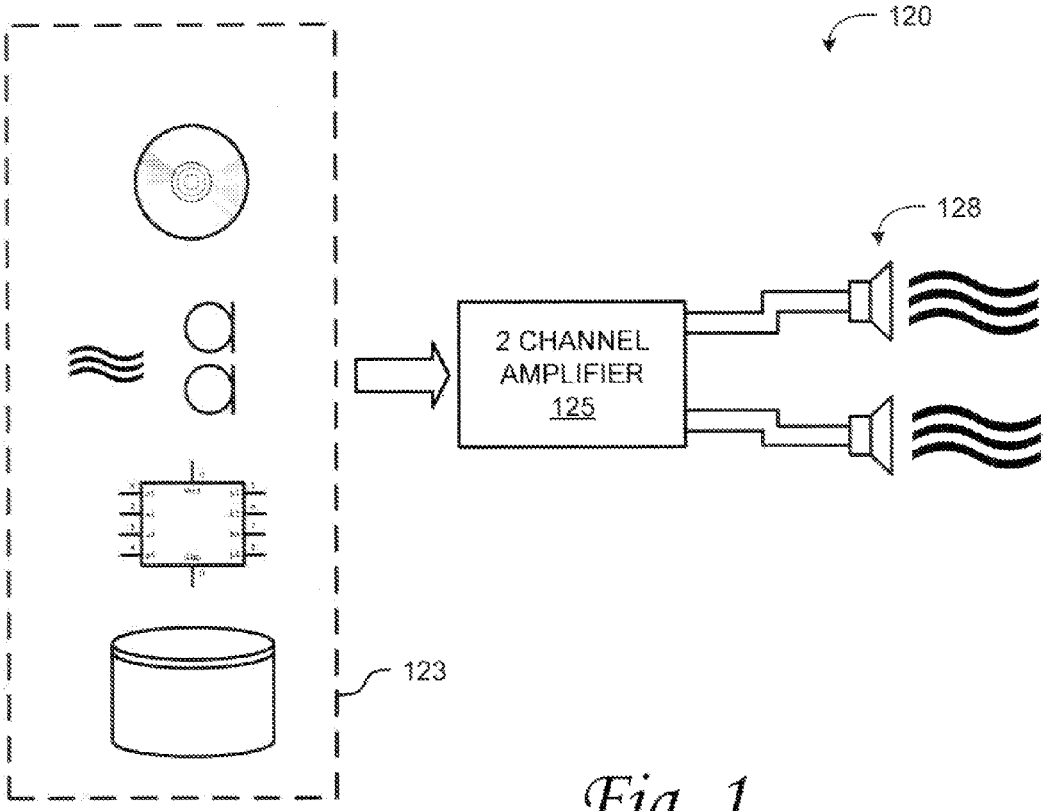
FIG. 1 is a diagram illustrating an example of a conventional audio sound system.

The figures are not intended to be exhaustive or to limit the invention to the precise form disclosed. It should be understood that the invention can be practiced with modification and alteration, and that the invention be limited only by the claims and the equivalents thereof.

SUMMARY

An ultrasonic, suppressed carrier audio system, can be configured to include a modulator having an output and an input, the input configured to receive an audio signal having audio content, the modulator configured to modulate the received audio signal onto a carrier to produce a modulated signal, wherein the carrier is at a frequency greater than 20 kHz; a band-pass filter having an input coupled to receive the modulated signal, and configured to suppress or remove the carrier from the modulated signal, and further configured to pass a sideband of the modulated signal thereby creating a suppressed carrier signal; and a first ultrasonic transducer having an input coupled to receive the suppressed carrier signal, the ultrasonic transducer configured to emit the suppressed carrier signal in a direction toward an intended listener. A demodulation circuit can also be included and can have a signal generator configured to generate a carrier signal and a second ultrasonic transducer having an input coupled to receive the carrier signal and to emit the carrier signal in a direction toward the intended listener. The devices may be configured such that in operation the carrier signal from the second ultrasonic transducer mixes with the suppressed carrier signal from the first ultrasonic transducer thereby resulting in an audible reproduction of the audio content. The modulator and demodulator may be in separate housings. The first and second transducers can be directed to emit their respective signals in a direction toward an intended listener such that the reproduced audio content is generated proximal to the listener. The demodulation circuit may be configured to be worn or carried by the listener in the proximity of the listener's ear.

Components of the system such as, for example, the modulator, bandpass filter and demodulation circuit can be implemented using a processor or digital signal processor.

In other embodiments, a method for generating an audio signal using suppressed carrier transmission includes: receiving an audio signal having audio content; modulating the received audio signal onto a carrier to produce a modulated signal, wherein the carrier is at a frequency greater than 20 kHz; suppressing or removing the carrier from the modulated signal, creating a suppressed carrier signal; and emitting the suppressed carrier signal via a first transducer in a direction toward an intended listener. A carrier signal can be generated and emitted via a second transducer in a direction toward the intended listener so that the carrier signal mixes with the suppressed carrier signal thereby resulting in an audible reproduction of the audio content.

DESCRIPTION

Embodiments of the systems and methods described herein provide suppressed-carrier audio transmission for a variety of different applications. Certain embodiments use suppressed-carrier audio transmission to transmit audio information to a listener, and the carrier is provided by a device at the listener's location (e.g., by an earpiece) to demodulate and reproduce the audio information in the proximity of the listener. In various embodiments, the audio is transmitted using single-sideband suppressed-carrier transmission, although other suppressed-carrier transmission techniques can be used such as suppressed-carrier double sideband transmission.

According to various embodiments of the systems and methods described herein, audio information is captured for transmission to one or more listeners. The audio information can be various forms of audio content, including, but not limited to, a musical work, speech, audio content from a movie or television program, a live performance, and so on. The audio information may be pre-recorded or it may be live. Examples of pre-recorded audio information might include, without limitation, pre-recorded musical performances (e.g., musical albums, concerts, songs, operas, and other performances) the audio content associated with a video program, speeches, and so on. The pre-recorded content can be stored in memory, on a disk, in the cloud, on audio CDs and DVDs, and on various other mediums or platforms, and can be stored as MP3 files or other file types. Examples of live audio information can be a live performance of a play, show, musical or other theatrical event; a live speech, presentation or talk; church or worship services; a tour guide presentation; or other live audio events or content.

FIG. 1 is a diagram illustrating an example of a conventional audio sound system. In a conventional audio system 120, audio content from an audio source 123, such as, for example, a microphone or microphones, memory, a data storage device, streaming media source, CD, DVD or other audio source is received. The audio content may be decoded and converted from digital to analog form, depending on the source. The audio content is amplified by an amplifier 125 and played to the listener or listeners over conventional loudspeakers 128. The audio is delivered to the listener(s) in the form of sound waves, which are detectable by human ears. An example of this is illustrated in FIG. 1.

Figure 2:
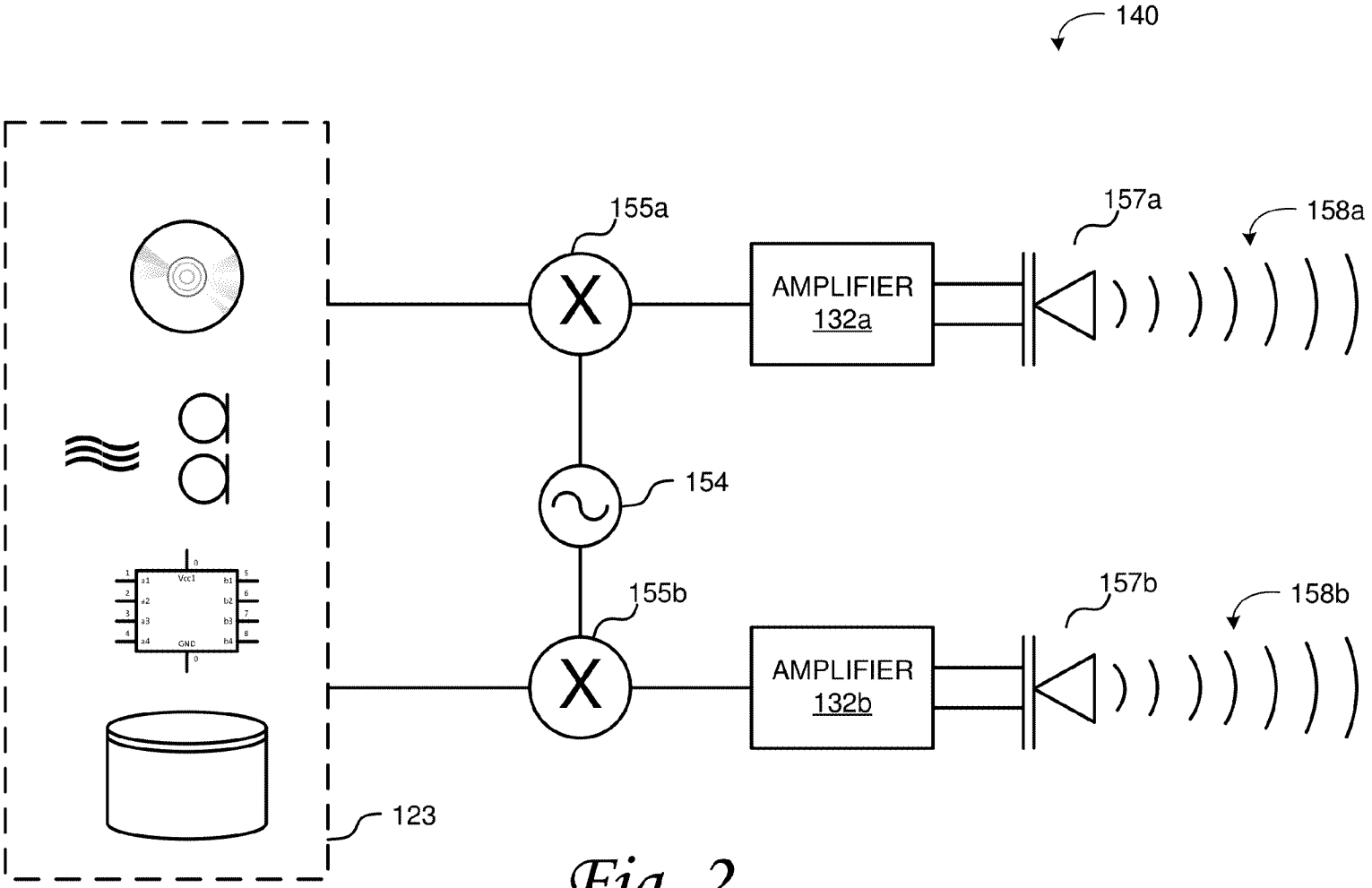
FIG. 2 is a diagram illustrating a conventional ultrasonic sound system.

FIG. 2 is a diagram illustrating a conventional ultrasonic sound system. In this exemplary conventional ultrasonic system 140, the audio content received by the audio system is modulated onto an ultrasonic carrier of frequency f1, using a modulator. The modulator typically includes a local oscillator 154 to generate the ultrasonic carrier signal, and multipliers 155*a* and 155*b* to multiply the audio signal by the carrier signal. The resultant signal is a double or single-sideband signal with a carrier at frequency f1. In most cases, the modulation scheme used is amplitude modulation, or AM. AM can be achieved by multiplying the ultrasonic carrier by the information-carrying signal, which in this case is the audio signal. The spectrum of the modulated signal has two sidebands, an upper and a lower side band, which are symmetric with respect to the carrier frequency, and the carrier itself.

The modulated ultrasonic signal is provided to the transducers 157*a* and 157*b*, which launch the ultrasonic wave into the air creating ultrasonic waves 158*a* and 158*b*. When played back through the transducers at a sufficiently high sound pressure level, due to nonlinear behavior of the air through which it is 'played' or transmitted, the carrier in the signal mixes with the sideband(s) to demodulate the signal and reproduce the audio content. This is sometimes referred to as self-demodulation. Thus, even for single-sideband implementations, the carrier must be included with the launched signal so that self-demodulation can take place.

In accordance with various embodiments of the systems and methods described herein, suppressed-carrier single- or double-sideband modulation is used so that the carrier is not included with the launched signal. The carrier is either completely suppressed, or sufficiently suppressed so that the signal is not demodulated during transmission absent a carrier provided from another source. Accordingly, only one or both of the sidebands (either the upper and/or the lower sideband) is launched into the air by the transducer(s). Without the carrier, or with a sufficiently suppressed carrier, the audio content is not demodulated in the air, and therefore cannot be heard by listeners without a demodulator. In some embodiments, a band-pass filter is used to filter out the carrier and unwanted sideband frequencies so that only the desired sideband(s) is/are passed to the transducer. The band-pass filter can be, for example, a high-pass filter to filter out the carrier and the lower side band, or a low-pass filter to filter out the carrier and the upper side band, or a band-pass filter to filter out just the carrier. The filter can be chosen with sufficiently sharp cutoff to suppress the carrier sufficiently without adversely affecting the desired sideband(s).

The ultrasonic carrier frequency, or frequency used to modulate the audio signal, can be any frequency that is above the range of human hearing. For example, the ultrasonic carrier frequency can be 20 kHz or greater, but is preferably 25 kHz or greater. In some embodiments, the ultrasonic carrier frequency is in the range of 35 kHz to 70 kHz. Likewise, the sidebands can be located at various frequencies above and below the center frequency. In one example embodiment, the ultrasonic carrier frequency is approximately 44 kHz, and sidebands are generated at ±1 k Hz.

At the listener, a demodulator is provided to recover the audio signal from the ultrasonic single-sideband signal(s). In various embodiments, a local oscillator is provided at the carrier frequency, fc, to provide the carrier needed to demodulate the audio. The carrier is launched into the air at the listener location, which can be accomplished using an amplifier to amplify the carrier signal (created by the oscillator) and an ultrasonic transducer to launch the amplified signal into the air. In the air, the locally generated carrier signal from the local oscillator mixes with the sideband(s) (e.g., the single-sideband audio signal), demodulating the single-sideband audio signal and resulting in sound pressure waves of the original audio content. Assuming sufficient energy in both the single-sideband signal and the carrier signal, the demodulated audio content can be heard by the listener at the location of the carrier signal.

Figure 3:
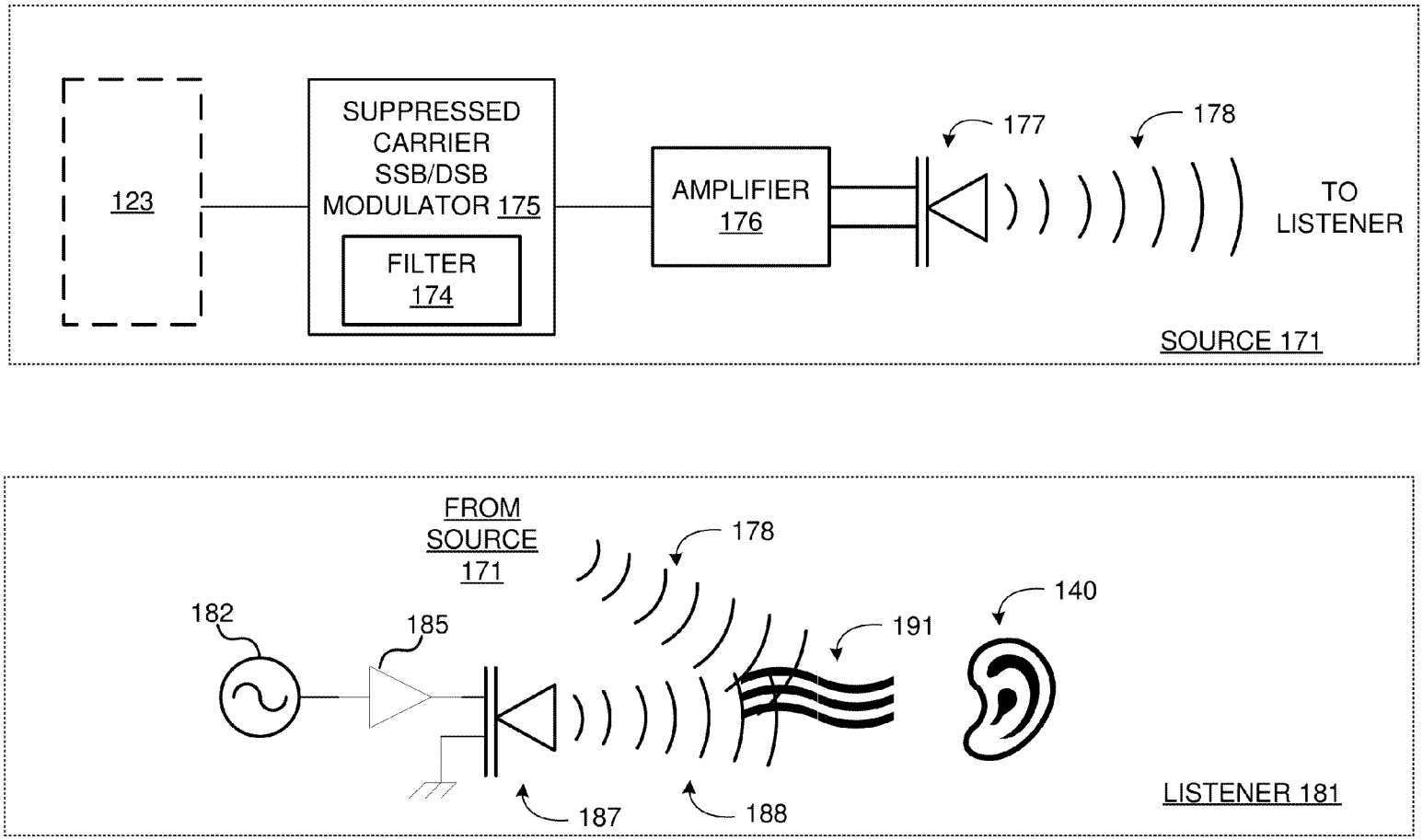
FIG. 3 is a diagram illustrating an example system for suppressed carrier ultrasonic audio transmission in accordance with one embodiment of the systems and methods described herein.

FIG. 3 is a diagram illustrating an example system for suppressed-carrier ultrasonic audio transmission in accordance with one embodiment of the systems and methods described herein. This example is described in terms of a single-sideband system. After reading this description, it will be apparent to one of ordinary skill in the art how to implement systems using double-sideband modulation. Referring now to FIG. 3, the audio content for transmission by the ultrasonic audio system is provided by source 123 to the modulator 175. As noted above with conventional audio systems, the audio source can be any of a variety of audio content sources such as, for example, microphone(s), data storage devices or memories, streaming media sources, CDs or DVDs, or other content sources. The audio can be decoded where needed and, if digitally stored, converted to analog form for modulation. Suppressed-carrier single-sideband modulator 175 modulates the audio signal using a local oscillator to generate the carrier frequency. The analog audio is amplitude modulated with the carrier to create a dual-sideband signal with a center carrier component and the upper and lower sidebands.

The suppressed carrier single-sideband modulator 175 includes digital band-pass filters 174 or other well-known techniques to filter out the unwanted sideband (either the low or the high) and to filter out and/or suppress the carrier. Alternatively, only the carrier is suppressed or removed. The remaining suppressed-carrier single-sideband signal is amplified by amplifier 176 and sent to transducer 177, which launches an ultrasonic wave 178 into the air for transmission to one or more listeners. Although only one transducer 177 is shown, one of ordinary skill in the art will understand after reading this description that multiple transducers can be used. In addition, multi-channel modulation and amplification can be used with multiple transducers to broadcast 'stereo' or other multi-channel audio content.

With continued reference to FIG. 3, at the listener location 181, an audio decoder is provided. Particularly, a local oscillator 182 is provided to generate a signal at the same frequency as the original carrier signal. This local carrier signal is amplified by amplifier 185 and launched into the air by transducer 187 to create the ultrasonic carrier signal 188 in the air in the proximity of the listener. The carrier signal 188 mixes with the single-sideband signal 178 from source 171, demodulating the single-sideband signal 178 and resulting in a sound pressure wave 191 of the audio content from source 123. This can be heard at the ear(s) 140 of the listener.

Eliminating one of the sidebands can eliminate more than half of the distortion. Additionally, recursive error correction or pre-correction can be performed at the source 171 to further improve the quality of the signal. For example, a Hilbert transform can be used to correct for anticipated distortions in the air. Examples of recursive error correction can be found in U.S. Pat. Nos. 7,729,498, 7,162,042 and 6,584,205, each of which are incorporated by reference herein in their entirety. As will be apparent to one of ordinary skill in the art, the various component such as the modulator, demodulator and filters can be implemented using analog techniques or using signal processing and analog/digital and digital/analog converters as appropriate. The signal processing may be implemented using a digital signal processor (DSP) or a general purpose processor, or other processors such as ASICs, FPGAs and the like.

Figure 4:
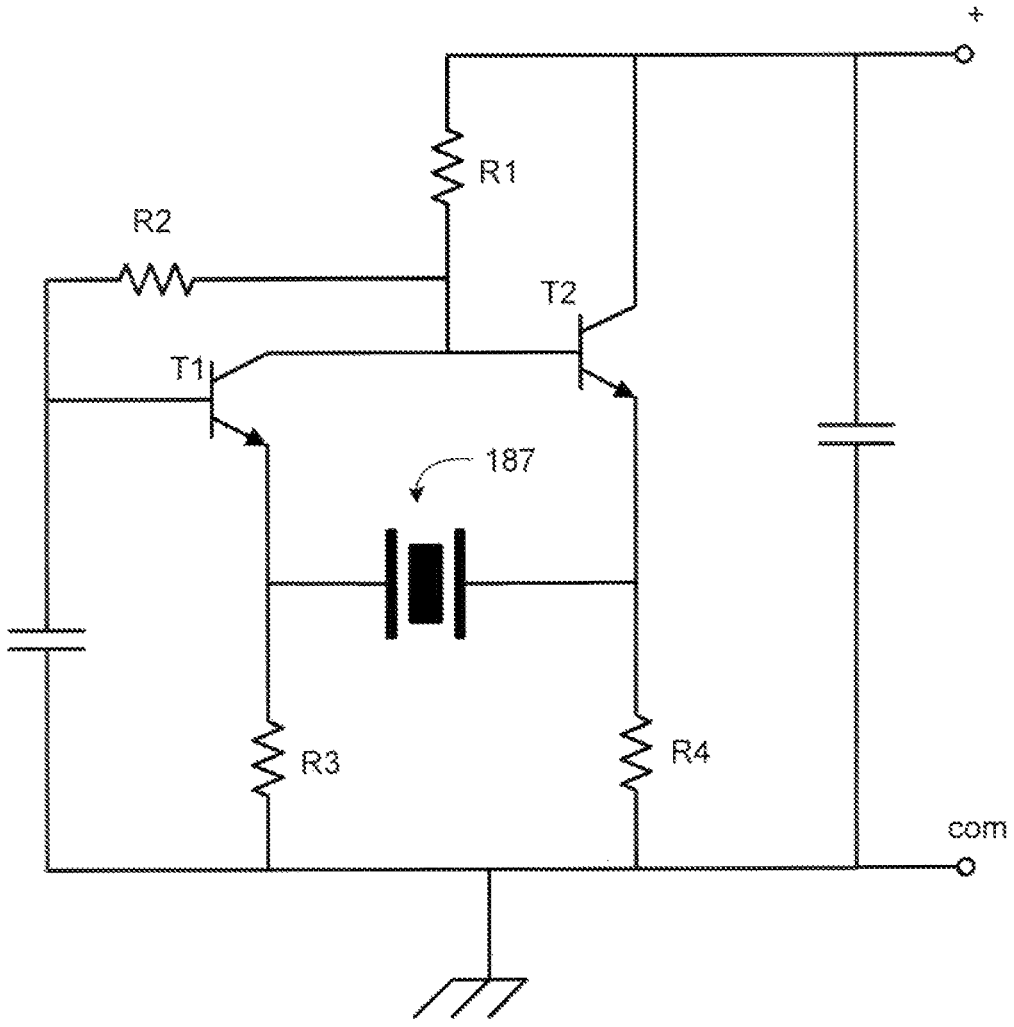
FIG. 4 is a diagram illustrating an example of a simple oscillator circuit that can be implemented at the listener location in accordance with one embodiment of the systems and methods described herein.

FIG. 4 is a diagram illustrating an example of a simple oscillator circuit that can be implemented at the listener location in accordance with one embodiment of the systems and methods described herein. Referring now to FIG. 4, in this example, two NPN transistors, T1 and T2, as emitter followers are used, and the ultrasonic transducer 187 forms part of an oscillator circuit. Resistor R1 biases transistor T2 and also serves as a load. Resistor R2 biases transistor T1. Resistors R3 and R4 set the bias levels of transistors T1 and T2 and to also load the circuit. After reading this description, one of ordinary skill in the art will understand how other oscillators or oscillator circuits can be used to generate the carrier signal.

Figure 5A:
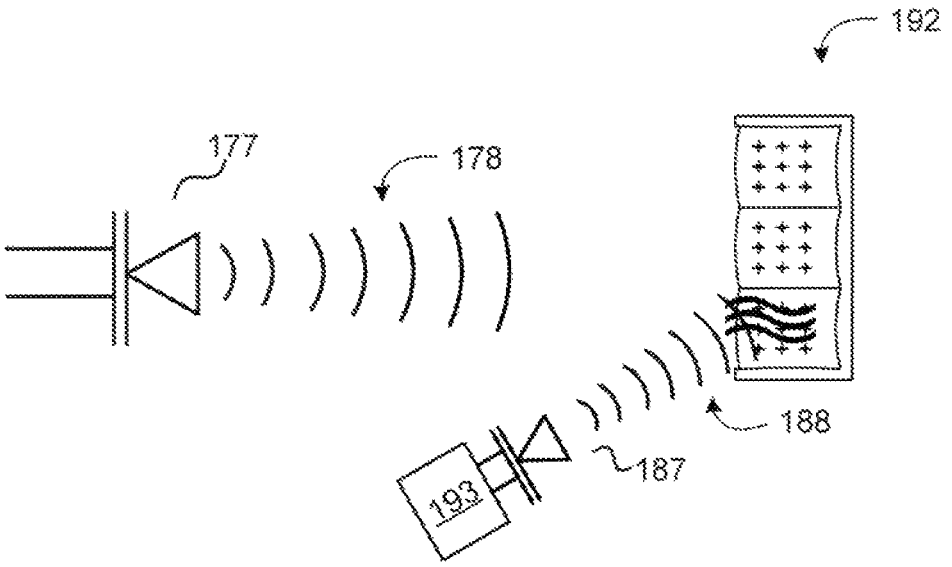
FIGS. 5A and 5B, is a diagram illustrating examples of possible configurations of ultrasonic sources and carrier sources in accordance with various embodiments of systems and methods described herein.

The receiver or demodulator circuit (also referred to as a decoder) that provides the carrier signal to demodulate the ultrasonic signal in the air can be configured to be placed so as to cause the demodulated sound wave to reach intended listeners. FIG. 5 is a diagram illustrating examples of possible configurations of ultrasonic sources and carrier sources in accordance with various embodiments of systems and methods described herein. FIG. 5A illustrates an example in which an ultrasonic transducer 177 launches a suppressed-carrier single-sideband ultrasonic signal 178 toward a listing position 192. An oscillator 193 generates the carrier signal which is launched through transducer 187 creating the ultrasonic carrier wave 188 directed at the listening position 192. At the listening position carrier 188 interacts with suppressed-carrier single-sideband signal 178 to create the sound pressure waves, thereby reproducing the audio content at the listening position 192.

The carrier producing circuit can be placed anywhere in the listening environment so as to provide the ultrasonic carrier signal to the listening position such it can interact with the suppressed-carrier single-sideband ultrasonic signal.

Because ultrasonic signals can be produced in a highly directional manner, the audio content delivered by the systems and methods described herein can be directed at a particular listener or group of listeners, or a particular listening position. The suppressed-carrier ultrasonic audio system described herein can also be provided in place of or in addition to a conventional audio delivery system. Accordingly, the audio content delivered by the ultrasonic system can be used as an exclusive audio delivery mechanism or to supplement audio content delivered by conventional means.

In some embodiments, the suppressed carrier audio system can be used to provide specialized or targeted audio delivery to the intended listener or listeners or to the intended listening position. For example, consider the case of a hearing-impaired listener. In this example, the local oscillator circuit can be provided to direct the carrier directly to the hearing-impaired listener so as to reconstruct the audio content in the proximity of the listener. Preferably, the audio content is reconstructed close enough to the listener and at a sufficient sound pressure level such that the hearing-impaired listener can adequately hear the reconstructed signal. For example, the oscillator and transducer circuit can be provided in a package small enough to fit within the listener's ear, behind the listener's ear or otherwise proximal to the listener's ear so as to provide the audio content for the intended listener. For example, in an in-the-ear configuration, the oscillator and transducer circuit can be configured to launch the carrier wave into the listener's ear and to demodulate the audio content in the ear. In this configuration, as well as in other configurations where the carrier is launched sufficiently close to the listener's ear, the carrier signal can be at a relatively low energy level. As these examples illustrate, the device can be configured as a hearing aid or assisted listening device in, at or near the ear. Because all that is required at the listener position is oscillator circuit with a small ultrasonic transducer, the device can be made in a small package with low power-consumption requirements. This is in contrast to conventional assisted listening devices or hearing aids, which typically require a microphone to capture the audio content, an amplifier to amplify the audio content, and a speaker to play back the audio content added amplified level in the listener's ear.

In various embodiments, the oscillator circuit can be disposed in noise-suppressing or noise-canceling headphones or headsets to allow filtering out of unwanted background noise or conventional audio signals. In such embodiments, the headset can be configured to generate the carrier and provide a carrier to each of the listener's ears, or to receive the carrier from an external source and pass the ultrasonic suppressed carrier signal to the listener's ear. The headset can be configured to receive and relay the ultrasonic suppressed carrier signal to the listener's ear so that the suppressed carrier signal can be demodulated and the audio content reproduced. In some embodiments, rather than generating a local carrier signal for demodulation in the air, the headset can include a receiver and demodulator to receive and demodulate the suppressed carrier ultrasonic signal and an amplifier and transducer to play back the demodulated audio content.

In-ear or behind-the-ear devices are not the only configuration that can be used to generate the carrier for demodulation. The carrier can be generated in handheld, tabletop, or other devices or device configurations to allow use by one listener or a group of listeners. Directionality of carrier-generation can be controlled by, for example, the configuration of the transducer 187. For example, when configured in a convex configuration the carrier signal can be directed in a broader field. Accordingly, tabletop or handheld models may be configured with a convex transducer to allow the carrier to be directed to more than one listener for demodulation of the suppressed carrier signal. Additionally, the demodulator can be configured with multiple transducers that can be switched in and out of the circuit to allow selectability of the directionality of the carrier signal. Accordingly, the demodulator can be used to selectively target various intended listeners.

Figure 5B:
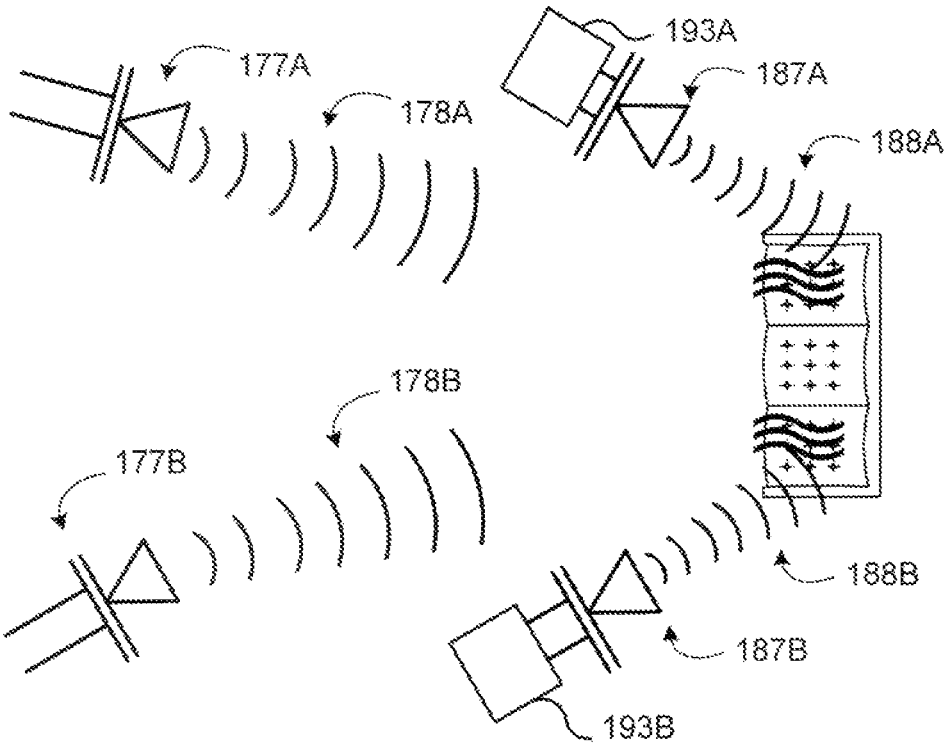

In various embodiments, different audio content can be reproduced using multiple different suppressed-carrier signals each operating at a different carrier frequencies. For example, multi-channel broadcasts can be implemented using different carriers to differentiate signals on each channel. As a further example, a suppressed-carrier stereo system can be implemented using two suppressed-carrier ultrasonic transmission systems, each operating at a different carrier frequency. The system would also include two demodulation circuits each configured to generate the ultrasonic carriers at the respective frequencies for each channel. An example of this is illustrated in FIG. 5B. Referring now to FIG. 5B, transducer 177A launches a first suppressed carrier signal 178A generated using a first carrier frequency. Likewise, transducer 177B launches a second suppressed carrier signal 178B generated using a second carrier frequency. For simplicity, the source 123, suppressed carrier modulator 175 and amplifier 176 are not shown in this figure. Two separate demodulators (e.g., oscillator and transducer circuits 193A, 193B) are provided to generate the two carriers necessary to demodulate suppressed carrier signals 178A, 178B. As illustrated in the example of FIG. 5B, these oscillators are configured to direct the carrier signals 188A, 188B to the desired listening position. Placing the oscillators in left and right positions relative to the listening area, and likewise positioning the suppressed carrier transducers in a like manner, allows the sound for the left and right channels to be directed to the listener's left and right ear. In various embodiments, the carrier can be the same frequency for the left and right (or more) channels. Accordingly, a single oscillator can be used to provide the carrier for all the channels.

In other embodiments, oscillator and transducer circuits 193A, 193B can be placed in other locations depending on the audio content and the desired form of audio reproduction. As a further example, two oscillator and transducer circuits can be provided to a listener, one for each ear. In-ear or behind-the-ear configurations can allow left and right ultrasonic signals to be reproduced as left and right audio content in, at or near the listener's ears.

Using multiple different carrier frequencies to create multiple suppressed-carrier signals is not limited for use with stereo or other multi-channel broadcasts, but can also be used to deliver different content to users simultaneously. In a situation where multiple suppressed carrier signals are delivered to a listening area the user with a local oscillator circuit will only be able to hear the broadcast that corresponds to the frequency of his or her local oscillator. Accordingly, different content can be targeted to different users simultaneously in the same listening environment. This can be used to deliver any of a number of different types of content to different users, but a few examples are described to further illustrate the utility of this approach.

For example, in one embodiment, different decoders (tabletop, headsets or earpieces) can be provided to the listeners, each decoder associated with a different movie-rating level. For example, a group of movie watchers in a room ranging in age from child to adult can be given a headset intended for their appropriate age group—for example, a G-rated, a PG-rated, a PG-13-rated, and an R-rated headset or other decoder. The content would be delivered in this example using four different suppressed carrier signals each generated at a different carrier frequency, one for each of the above-specified ratings. Accordingly, a listener's headset would generate only one carrier and therefore only demodulate one of the suppressed-carrier signals. Particularly, the G-rated headset will demodulate the G-rated suppressed carrier signal thereby delivering the G-rated audio content to the listener. For example, this content may be content with certain words or phrases removed from the dialogue or certain words or phrases replaced more appropriate words or phrases for the age group. Each user can be given one or more decoders to decode the audio depending on the number of channels of audio content.

As another example, in other embodiments the program content can be encoded onto different suppressed-carrier signals based on language. For example, there may be multiple audio tracks, one each for the English language, Spanish language, or other languages. As with the example described above, each user would select the appropriate decoder for the language in which he or she wishes to receive the content. The decoder provides the carrier signal at the correct frequency to demodulate the suppressed-carrier signal for the chosen language.

As yet another example, a museum or other tourist location may be configured to provide different audio content to different listeners based on age or level of education (as well as, in addition to in different languages). Schoolchildren, college students, graduate students, or adults can be given decoders to decode audio content appropriate for their age, education, or level of experience. The decoder provides the correct carrier signal frequency to demodulate the suppressed carrier signal for the chosen content level.

Because the suppressed carrier ultrasonic signals cannot be heard without a local oscillator to produce the carrier signal (i.e., without a decoder), only users with a local oscillator to produce the correct ultrasonic carrier signal will be able to hear the audio broadcast. Accordingly, in addition to allowing the ability to broadcast different audio content simultaneously, security or privacy can be maintained using suppressed carrier audio systems. Accordingly, access to audio content can be controlled by controlling access to decoders to generate the required carrier signal at the appropriate frequency. This can be useful in a number of different applications at a number of different venues. For example, consider a concert, sporting event, or other like venue where ushers and security personnel are interspersed with the crowd. The ushers and security personnel can be given the appropriate ultrasonic decoders so that they can hear instructions from a staff coordinator and such instructions are not heard by the event attendees. As another example, in a tourist attraction suppressed carrier ultrasonic signals can be used to broadcast audio content describing the various exhibits or features of the attraction. Using suppressed-carrier ultrasonic signals, only guests with the appropriate decoder will be able to hear the audio content. Accordingly, access to the audio content can be controlled.

As these examples serve to illustrate, there are a number of different applications in which different program content can be targeted to predetermined individuals or groups of individuals using suppressed-carrier signals generated using different carrier frequencies. Likewise, the systems and methods described herein can be implemented in a number of different environments from small personal environments such as the home or office to other environments such as churches, schools, museums, sporting venues, and any of a number of other environments.

While various embodiments of the present invention have been described above, it should be understood that they have been presented by way of example only, and not of limitation. Likewise, the various diagrams may depict an example architectural or other configuration for the invention, which is done to aid in understanding the features and functionality that can be included in the invention. The invention is not restricted to the illustrated example architectures or configurations, but the desired features can be implemented using a variety of alternative architectures and configurations. Indeed, it will be apparent to one of skill in the art how alternative functional, logical or physical partitioning and configurations can be implemented to implement the desired features of the present invention. Also, a multitude of different constituent module names other than those depicted herein can be applied to the various partitions. Additionally, with regard to flow diagrams, operational descriptions and method claims, the order in which the steps are presented herein shall not mandate that various embodiments be implemented to perform the recited functionality in the same order unless the context dictates otherwise.

Although the invention is described above in terms of various exemplary embodiments and implementations, it should be understood that the various features, aspects and functionality described in one or more of the individual embodiments are not limited in their applicability to the particular embodiment with which they are described, but instead can be applied, alone or in various combinations, to one or more of the other embodiments of the invention, whether or not such embodiments are described and whether or not such features are presented as being a part of a described embodiment. Thus, the breadth and scope of the present invention should not be limited by any of the above-described exemplary embodiments.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; the terms "a" or "an" should be read as meaning "at least one," "one or more" or the like; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any time in the future.

The presence of broadening words and phrases such as "one or more," "at least," "but not limited to" or other like phrases in some instances shall not be read to mean that the narrower case is intended or required in instances where such broadening phrases may be absent. The use of the term "module" does not imply that the components or functionality described or claimed as part of the module are all configured in a common package. Indeed, any or all of the various components of a module, whether control logic or other components, can be combined in a single package or separately maintained and can further be distributed in multiple groupings or packages or across multiple locations.

Additionally, the various embodiments set forth herein are described in terms of exemplary block diagrams, flow charts and other illustrations. As will become apparent to one of ordinary skill in the art after reading this document, the illustrated embodiments and their various alternatives can be implemented without confinement to the illustrated examples. For example, block diagrams and their accompanying description should not be construed as mandating a particular architecture or configuration.

The invention claimed is:

1. An ultrasonic, suppressed carrier audio system, comprising:

a modulator having an output and an input, the input configured to receive an audio signal having audio content, the modulator configured to modulate the received audio signal onto a carrier to produce a modulated signal, wherein the carrier is at a frequency greater than 20 kHz;

a band-pass filter, low pass filter, or high pass filter having an input coupled to receive the modulated signal, and configured to suppress or remove the carrier from the modulated signal, and further configured to pass a sideband of the modulated signal thereby creating a suppressed-carrier signal;

a first ultrasonic transducer having an input coupled to receive the suppressed-carrier signal, the ultrasonic transducer configured to emit the suppressed-carrier signal into the air in a direction toward an intended listener; and a demodulation circuit having a signal generator configured to generate a carrier signal and a second ultrasonic transducer having an input coupled to receive the carrier signal and to emit the carrier signal in a direction toward the intended listener.

2. The ultrasonic, suppressed carrier audio system of claim 1, wherein in operation the carrier signal from the second ultrasonic transducer mixes with the suppressed-carrier signal from the first ultrasonic transducer in the air thereby resulting in an audible reproduction of the audio content.

3. The ultrasonic, suppressed carrier audio system of claim 1, wherein at least one of the modulator, filter and demodulation circuit are implemented using a processor or digital signal processor.

4. The ultrasonic, suppressed carrier audio system of claim 1, wherein the modulator and demodulation circuit are in separate housings.

5. The ultrasonic, suppressed carrier audio system of claim 1, wherein the modulator, filter and first ultrasonic transducer are configured to emit the suppressed-carrier signal from a first location, and the demodulation circuit with the second ultrasonic transducer is configured to emit the carrier signal from a second location.

6. The ultrasonic, suppressed carrier audio system of claim 5, wherein the demodulation circuit is configured to be worn or carried by the listener in the proximity of the listener's ear.

7. The ultrasonic, suppressed carrier audio system of claim 1, wherein the first and second transducers are configured to be positionable such that they are able to emit their respective signals in a direction toward an intended listener such that the reproduced audio content is generated proximal to the listener.

8. The ultrasonic, suppressed carrier audio system of claim 1, wherein the carrier frequency is above 25 kHz.

9. The ultrasonic, suppressed carrier audio system of claim 1, wherein the carrier frequency is in a range of 35 kHz to 70 kHz.

10. The ultrasonic, suppressed carrier audio system of claim 1, wherein the carrier frequency is above 70 kHz.

11. An assisted listening device, comprising a transmitter and a receiver;

the transmitter comprising:

a modulator having an output and an input, the input configured to receive an audio signal having audio content, the modulator configured to modulate the received audio signal onto a carrier to produce a modulated signal, wherein the carrier is at a frequency greater than 20 kHz;

a band-pass filter, low pass filter, or high pass filter having an input coupled to receive the modulated signal, and configured to suppress or remove the carrier from the modulated signal, and further configured to pass a sideband of the modulated signal thereby creating a suppressed-carrier signal; and a first ultrasonic transducer having an input coupled to receive the suppressed-carrier signal, the ultrasonic transducer configured to emit the suppressed-carrier signal into the air in a direction toward an intended listener; and the receiver comprising:

a demodulation circuit having a signal generator configured to generate a carrier signal and a second ultrasonic transducer having an input coupled to receive the carrier signal and configurable to be positioned so as to emit the carrier signal in a direction toward the intended listener.

12. The assisted listening device of claim 11, wherein the assisted listening device is a hearing aid and wherein the receiver is packaged to be worn by the intended listener such that the second ultrasonic transducer is positioned to emit the carrier signal in a direction toward the intended listener.

13. The assisted listening device of claim 11, wherein in operation the carrier signal from the second ultrasonic transducer mixes with the suppressed-carrier signal from the first ultrasonic transducer in the air thereby resulting in an audible reproduction of the audio content.

14. The assisted listening device of claim 11, wherein at least one of the modulator, filter and demodulation circuit are implemented using a processor or digital signal processor.

15. The assisted listening device of claim 11, wherein the transmitter and receiver are in separate housings.

16. The assisted listening device of claim 11, wherein the transmitter is configured to emit the suppressed-carrier signal from a first location, and the receiver is configured to emit the carrier signal from a second location.

17. The assisted listening device of claim 11, wherein the assisted listening device is a hearing aid, and wherein the demodulation circuit is configured to be worn at the listener's ear.

18. The assisted listening device of claim 11, wherein the demodulation circuit is configured to output.

19. A method for generating an audio signal using suppressed carrier transmission, the method, comprising:

receiving an audio signal having audio content;

modulating the received audio signal onto a carrier to produce a modulated signal, wherein the carrier is at a frequency greater than 20 kHz;

suppressing or removing the carrier from the modulated signal, creating a suppressed-carrier signal;

emitting the suppressed-carrier signal via a first transducer into the air in a direction toward an intended listener; and generating a carrier signal and emitting the carrier signal via a second transducer in a direction toward the intended listener so that the carrier signal mixes with the suppressed-carrier signal in the air thereby resulting in an audible reproduction of the audio content.

20. The method of claim 19, wherein suppressing or removing the carrier comprises allowing a sideband of the modulated signal to remain in the modulated signal.

* * * * *